US011885346B2

(12) United States Patent
Pae et al.

(10) Patent No.: US 11,885,346 B2
(45) Date of Patent: Jan. 30, 2024

(54) WATER PUMP

(71) Applicant: COAVIS, Sejong-si (KR)

(72) Inventors: Wan Sung Pae, Sejong-si (KR); Hyun Tae Lee, Sejong-si (KR); Joon Seup Kim, Sejong-si (KR)

(73) Assignee: COAVIS, Sejong-si (KR)

( * ) Notice: Subject to any disclaimer, the term of this patent is extended or adjusted under 35 U.S.C. 154(b) by 0 days.

(21) Appl. No.: 17/835,475

(22) Filed: Jun. 8, 2022

(65) Prior Publication Data

US 2022/0403852 A1 Dec. 22, 2022

(30) Foreign Application Priority Data

Jun. 9, 2021 (KR) ..... 10-2021-0074630

(51) Int. Cl.

| | |
|---|---|
| ***F04D 29/046*** | (2006.01) |
| ***F04D 29/42*** | (2006.01) |
| ***F04D 13/06*** | (2006.01) |
| ***F04D 29/62*** | (2006.01) |
| ***F04D 29/041*** | (2006.01) |

(Continued)

(52) U.S. Cl.

CPC ..... *F04D 29/0462* (2013.01); *F04D 13/026* (2013.01); *F04D 13/06* (2013.01); *F04D 13/0606* (2013.01); *F04D 13/0633* (2013.01); *F04D 29/026* (2013.01); *F04D 29/043* (2013.01); *F04D 29/046* (2013.01); *F04D 29/0413* (2013.01); *F04D 29/426* (2013.01); *F04D 29/62* (2013.01)

(58) Field of Classification Search

CPC .... F04D 13/0633; F04D 13/026; F04D 13/06; F04D 29/426; F04D 13/0606; F04D 29/026; F04D 29/043; F04D 29/0413; F04D 29/046; F04D 29/62; F04D 29/0462

See application file for complete search history.

(56) References Cited

U.S. PATENT DOCUMENTS 3,288,073 A * 11/1966 Pezzillo ..... F04D 13/0613 415/110
4,013,384 A * 3/1977 Oikawa ..... F04D 29/0413 415/10

(Continued)

FOREIGN PATENT DOCUMENTS

| | | | |
|---|---|---|---|
| KR | 1020200043187 | A | 4/2020 |
| KR | 102178862 | B1 | 11/2020 |
| KR | 1020210034924 | A | 3/2021 |

*Primary Examiner* — Peter J Bertheaud

(74) *Attorney, Agent, or Firm* — The Webb Law Firm

(57) ABSTRACT

The present invention relates to a water pump including a lower casing in which a rotor accommodating part is formed to protrude downwardly and a lower bearing mounting part is formed at a lower end of an inner portion; an upper casing in which an inlet part introducing a fluid and an outlet part discharging the fluid are formed and an upper bearing mounting part is formed to extend from a lower end of the inlet part toward the impeller accommodating space; an impeller rotatably provided in the impeller accommodating space; and a rotor provided in the rotor accommodating space of the lower casing and coupled to the impeller. A fluid may smoothly flow toward an introduction side of the impeller, and thus, a pressure drop of the fluid and an unstable flow of the fluid may be prevented to improve performance.

10 Claims, 8 Drawing Sheets

(51) Int. Cl.

| | |
|---|---|
| ***F04D 29/02*** | (2006.01) |
| ***F04D 29/043*** | (2006.01) |
| ***F04D 13/02*** | (2006.01) |

(56) References Cited

U.S. PATENT DOCUMENTS

| | | | | |
|---|---|---|---|---|
| 5,039,286 | A * | 8/1991 | Point | F04D 13/06<br>417/424.2 |
| 6,524,078 | B1 * | 2/2003 | Brooks | F04D 13/021<br>417/423.1 |
| 6,939,115 | B2 * | 9/2005 | Knoll | F04D 29/047<br>417/423.12 |
| 7,249,939 | B2 * | 7/2007 | Yanagihara | F04D 29/026<br>417/420 |
| 10,125,792 | B2 * | 11/2018 | Nakano | F04D 29/4273 |

* cited by examiner

WATER PUMP

CROSS-REFERENCE TO RELATED APPLICATION

This application claims priority to Korean Patent Application No. 10-2021-0074630 filed Jun. 9, 2021, the disclosure of which is hereby incorporated by reference in its entirety.

BACKGROUND OF THE INVENTION

Field of the Invention

The following disclosure relates to a water pump for pressure-feeding a coolant by rotating an impeller.

Description of Related Art

A water pump is a device for circulating a coolant to an engine or a heater in order to cool the engine or heat an interior. Such a water pump is mainly divided into a mechanical water pump and an electric water pump.

The mechanical water pump is a pump connected to a crankshaft of an engine and driven according to the rotation of the crankshaft, and the electric water pump is a pump driven by the rotation of a motor controlled by a control device.

The electric water pump mainly includes a housing, a stator, and a rotor constituting a motor unit; and an impeller and an impeller casing constituting a pump unit. In addition, the stator is provided in the housing and fixed to the housing, the rotor is disposed inside the stator so as to be spaced apart from the stator, the impeller is coupled to a rotation shaft of the rotor, and the impeller casing is coupled to the housing so as to cover and block the impeller.

FIGS. 1 and 2 are, respectively, an exploded perspective view and a front cross-sectional view illustrating an example of a conventional electric water pump.

As illustrated in FIGS. 1 and 2, the conventional electric water pump is configured to mainly include a motor housing 30, a stator 10, a lower casing 20, an upper casing 60, an impeller 50, and a rotor 40. The motor housing 30 is formed in the shape of a concave container of which an upper side is opened, the stator 10 is inserted into the motor housing 30, and the lower casing is coupled to an upper side of the motor housing 30, such that a rotor accommodating part 21 of the lower casing 20 penetrate through and is inserted into a hollowed inner portion of the stator 10. In addition, the rotor 40 is inserted into the rotor accommodating part 21, the impeller 50 is disposed on an upper side of the rotor 40, and the rotor 40 and the impeller 50 are integrally coupled to each other. In addition, the upper casing 60 is coupled to an upper side of the lower casing 20, and the impeller 50 is disposed in an impeller accommodating space, which is an internal space formed by the coupling between the lower casing 20 and the upper casing 60. In addition, a lower bearing mounting part 22 is formed at a lower end of the rotor accommodating part 21 of the lower casing 20, and a lower bearing 42 including a bushing B and a support pin P is coupled to the lower bearing mounting part 22. In addition, the upper casing 60 includes support parts 65 extending from an inner wall of an introduction flow path in an inner diameter direction and having a plate shape and an upper bearing mounting part 64 coupled to inner side ends of the support parts 65, and an upper bearing 43 including a bushing B and a support pin P is coupled to the upper bearing mounting part 64. Thus, a lower end of a rotation shaft 41 of the rotor 40 is rotatably coupled to the lower bearing 42, and an upper end of the rotation shaft 41 of the rotor 40 is rotatably coupled to the upper bearing 43.

Here, in the conventional electric water pump, the upper bearing mounting part 64 is disposed in the introduction flow path at an inlet 61 side through which a fluid is introduced. Therefore, a pressure drop of the fluid introduced into an inlet side of the impeller 50 occurs, and turbulence is generated while the fluid passes through the vicinity of the upper bearing mounting part 64, such that performance of the electric water pump is deteriorated due to an unstable flow of the fluid.

RELATED ART DOCUMENT

[Patent Document]
KR 10-2178862 B1 (2020 Nov. 9) "Electric Water Pump"

SUMMARY OF THE INVENTION

An embodiment of the present invention is directed to providing a water pump capable of preventing a pressure drop of a fluid introduced into an introduction side of an impeller by allowing the fluid to flow smoothly and improving performance by preventing an unstable flow of the fluid.

In one general aspect, a water pump includes: a lower casing in which a rotor accommodating part having a rotor accommodating space formed downwardly concavely from an upper surface thereof is formed to protrude downwardly and a lower bearing mounting part is formed at a lower end of an inner portion of the rotor accommodating part; an upper casing which is coupled to an upper side of the lower casing and has an impeller accommodating space formed therein by the coupling with the lower casing and in which an inlet part in communication with the impeller accommodating space to introduce a fluid and an outlet part discharging the fluid are formed and an upper bearing mounting part is formed to extend from a lower end of the inlet part toward the impeller accommodating space; an impeller rotatably provided in the impeller accommodating space; and a rotor provided in the rotor accommodating space of the lower casing, coupled to the impeller, and having a rotation shaft of which both ends are rotatably coupled to the lower bearing mounting part and the upper bearing mounting part.

The upper casing may further include a plurality of supports having upper ends connected to an inner wall of the lower end of the inlet part and lower ends connected to the upper bearing mounting part.

The plurality of supports may be disposed to be spaced apart along a circumferential direction, and the plurality of supports may be formed to extend to be inclined in an inner diameter direction toward a downward direction.

The upper bearing mounting part may have an inclined surface formed so that an upper side thereof is inclined in the inner diameter direction toward an upward direction, and the lower ends of the plurality of supports may be connected to the inclined surface of the upper bearing mounting part.

A portion or entirety of the upper bearing mounting part may be disposed in an introduction side of the impeller.

An insertion groove may be formed downwardly concavely formed in a lower end of an introduction side of the impeller and an upper end of the rotor, and the upper bearing mounting part may be inserted into the insertion groove and be disposed to be spaced apart from the insertion groove.

A lower end of the inclined surface of the upper bearing mounting part may be disposed at a height corresponding to an inner bottom surface of the impeller adjacent thereto.

The inner bottom surface of the impeller may be formed in a shape in which it is inclined or bent upwardly from an outer side in a radial direction toward an inner side in the radial direction.

A lower bearing may be coupled to the lower bearing mounting part, an upper bearing may be coupled to the upper bearing mounting part, and the both ends of the rotation shaft of the rotor may be rotatably coupled to the lower bearing and the upper bearing.

The water pump may further include: a motor housing formed in the shape of a concave container of which an upper side is opened; and a stator provided in the motor housing.

| [Detailed Description of Main Elements] | |
|---|---|
| 100: stator | |
| 200: lower casing | |
| 211: lower seating groove | 212: lower flow path groove |
| 220: rotor accommodating part | |
| 221: rotor accommodating space | 222: lower bearing mounting part |
| 300: motor housing | |
| 400: rotor | 410: rotation shaft |
| 411: lower bearing | 412: upper bearing |
| 420: insertion groove | |
| B: bushing | P: support pin |
| 500: impeller | |
| 510: upper plate | 520: lower plate |
| 530: blade | |
| 600: upper casing | |
| 601: impeller accommodating space | 602: upper bearing mounting part |
| 603: inclined surface | |
| 610: inlet part | 611: introduction flow path |
| 612: support | |
| 620: outlet part | 621: discharge flow path |
| 630: upper seating groove | 632: upper flow path groove |

DESCRIPTION OF THE INVENTION

Hereinafter, a water pump according to the present invention will be described in detail with reference to the accompanying drawings.

Figure 1:
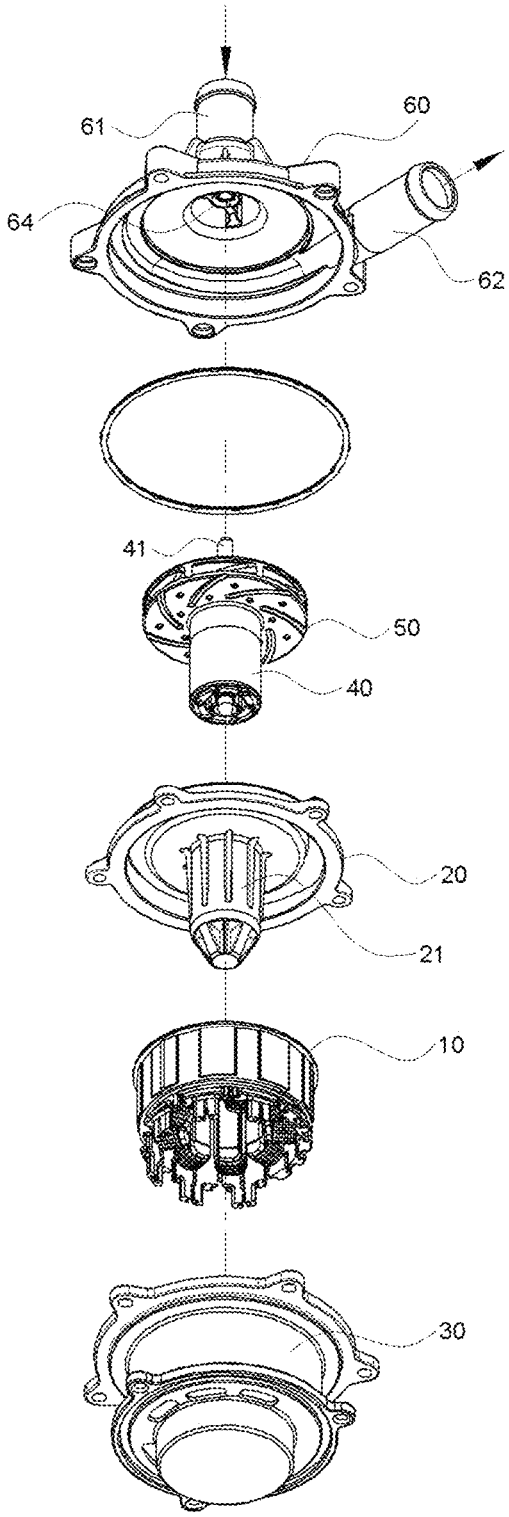
FIG. 1 PRIOR ART
FIGS. 1 and 2 are, respectively, an exploded perspective view and a front cross-sectional view illustrating an example of a conventional electric water pump.
Figure 2:
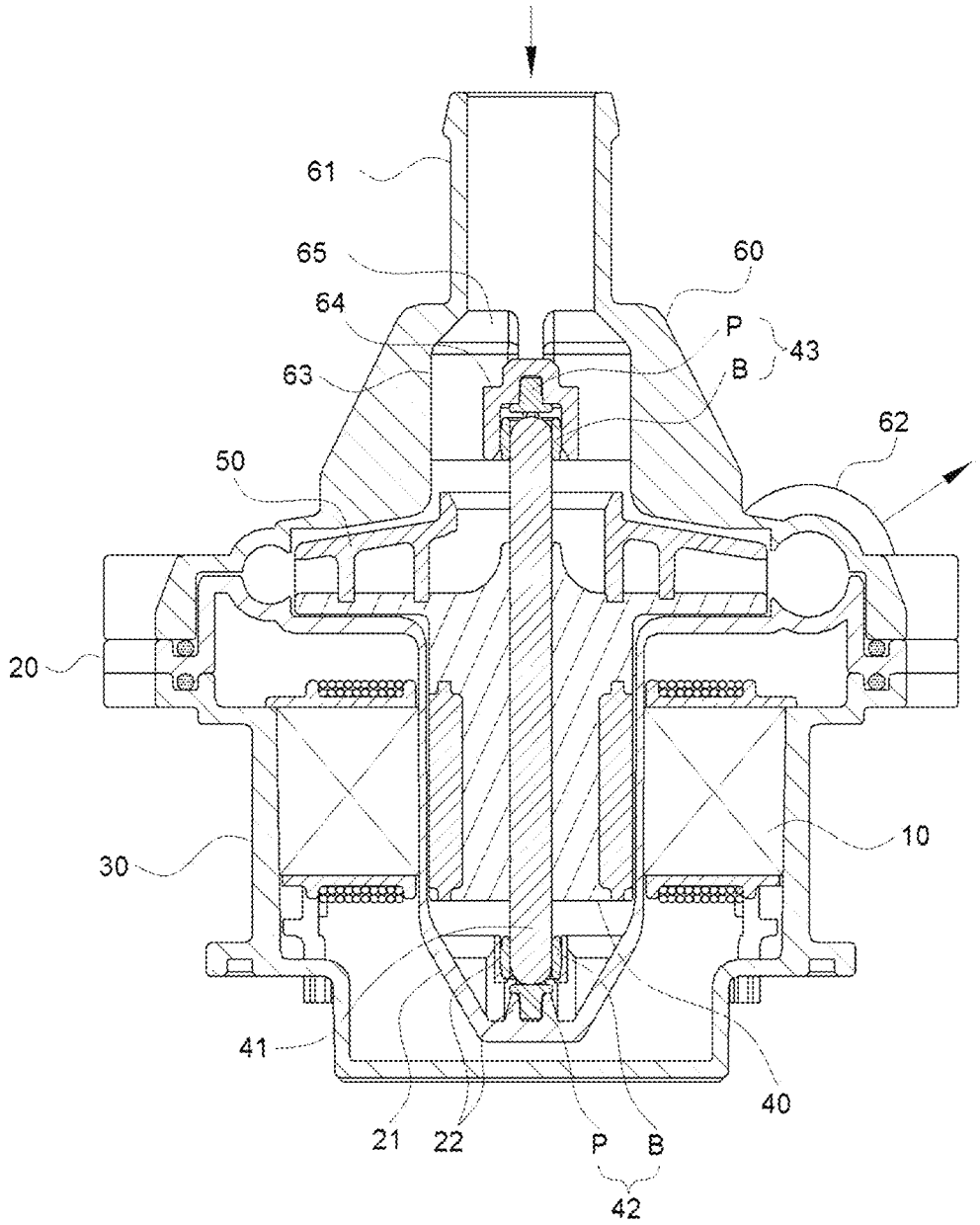
FIG. 2 PRIOR ART
Figure 3:
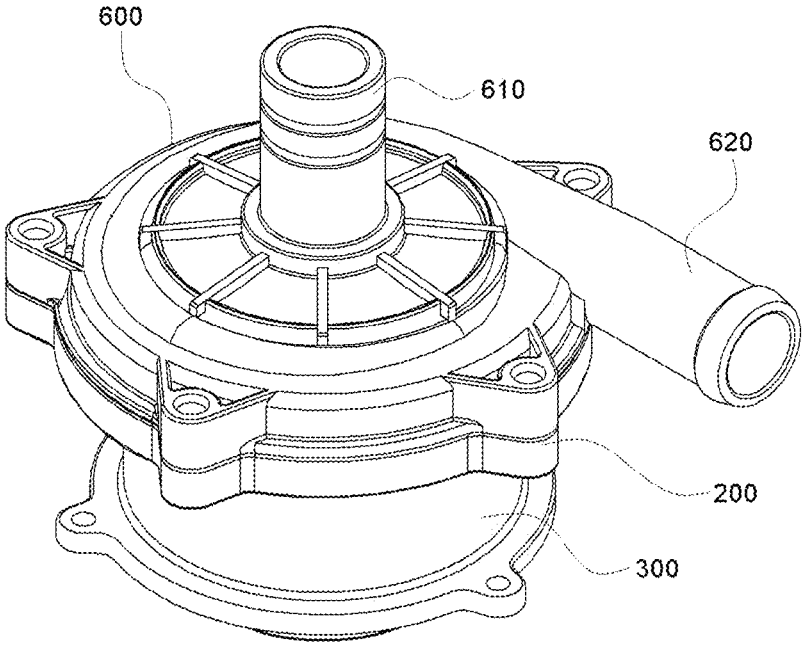
FIGS. 3 to 5 are, respectively, an assembled perspective view, an exploded perspective view, and a front cross-sectional view illustrating a water pump according to an embodiment of the present invention.
Figure 4:
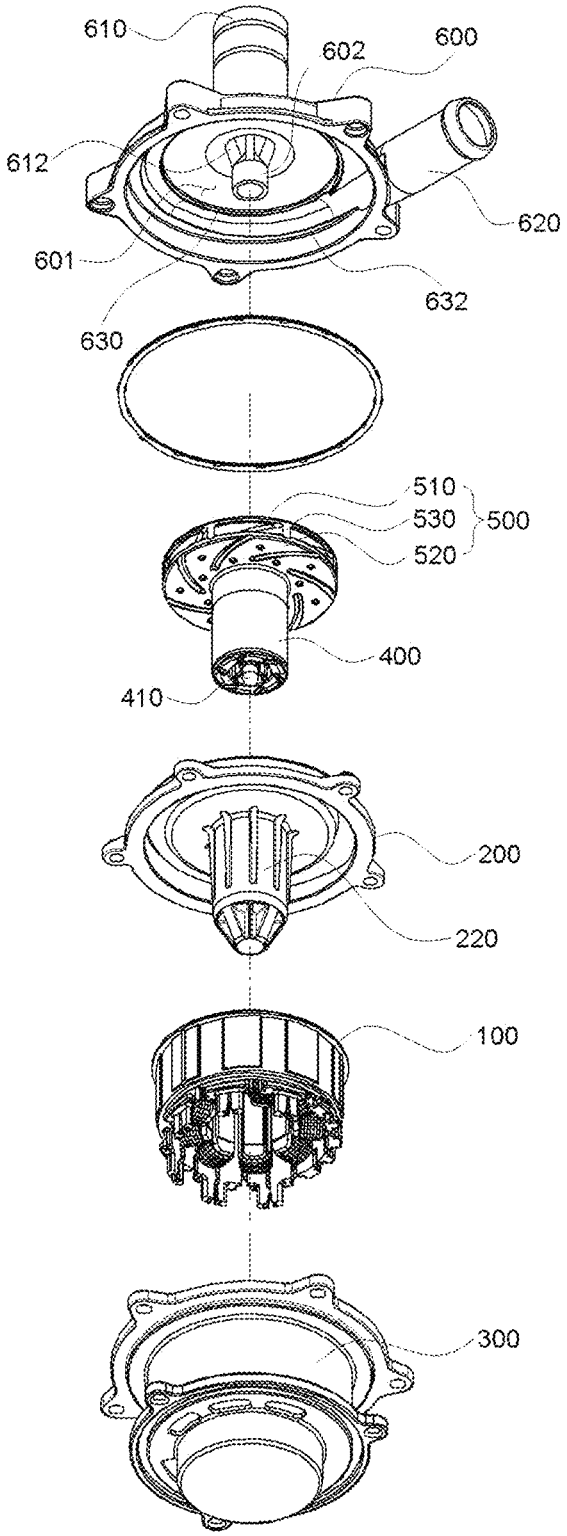
Figure 5:
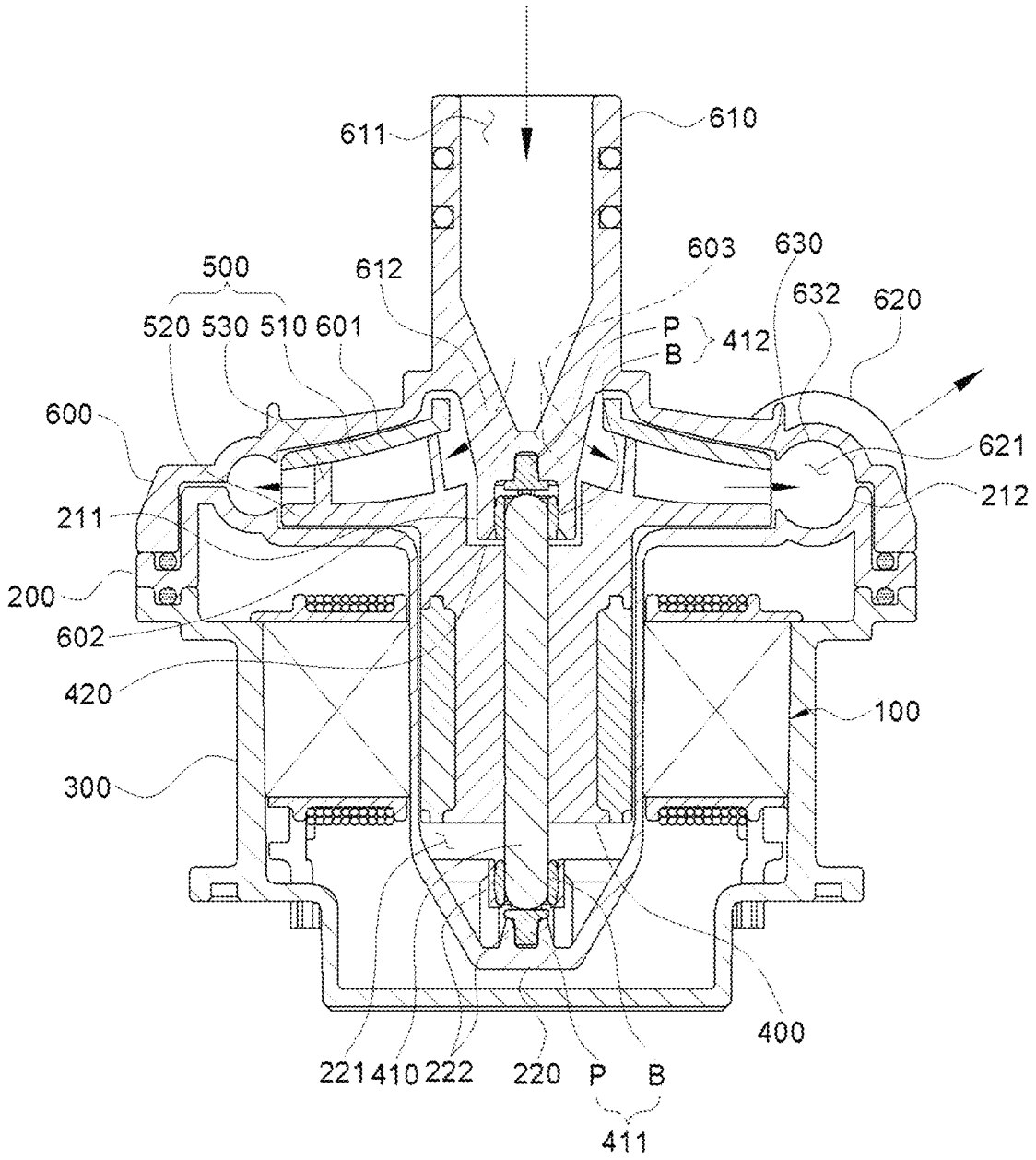
Figure 6:
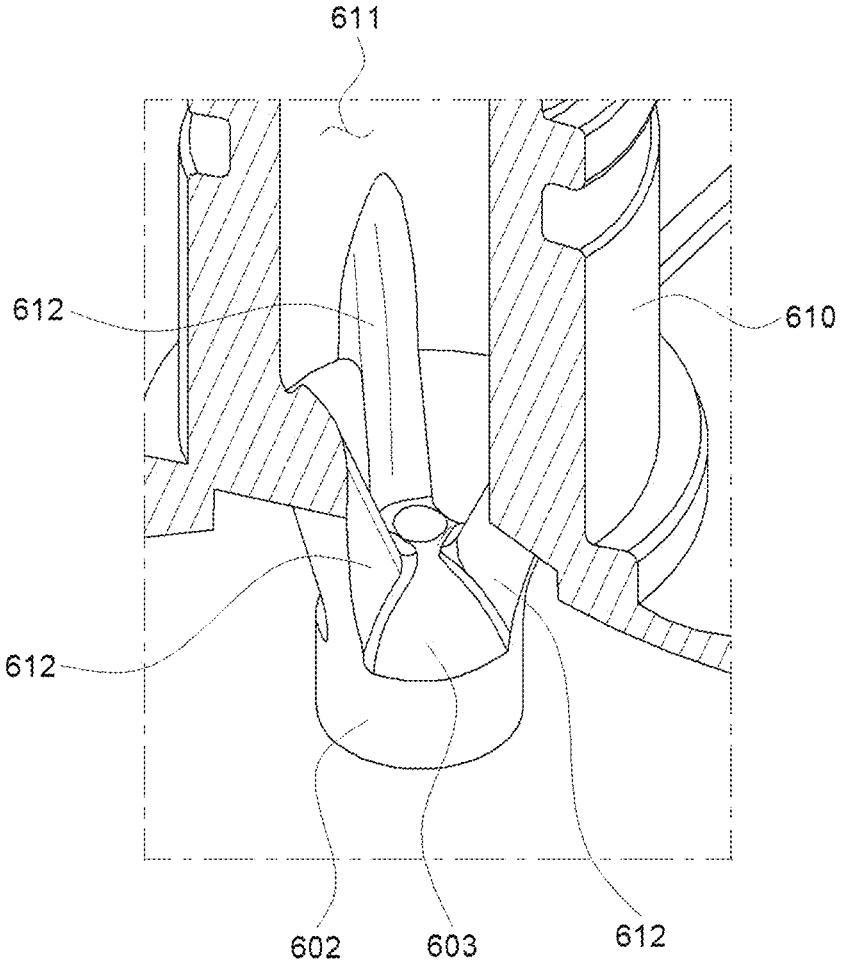
FIG. 6 is a partial cross-sectional perspective view illustrating a lower end of an inlet part and an upper bearing mounting part in an upper casing of the water pump according to an embodiment of the present invention.

FIGS. 3 to 5 are, respectively, an assembled perspective view, an exploded perspective view, and a front cross-sectional view illustrating a water pump according to an embodiment of the present invention, and FIG. 6 is a partial cross-sectional perspective view illustrating a lower end of an inlet part and an upper bearing mounting part in an upper casing of the water pump according to an embodiment of the present invention.

As illustrated in FIGS. 3 to 6, a water pump according to an embodiment of the present invention may be configured to mainly include a lower casing 200, an upper casing 600, an impeller 500, and a rotor 400, and may further include a motor housing 300 and a stator 100.

The motor housing 300 may be formed in the shape of a concave container made of a metal material, and may be formed in a shape in which an inner portion thereof is empty and an upper side thereof is opened. In addition, a lower end of the motor housing 300 may be closed, a side surface of the motor housing 300 may be formed in a cylindrical shape, and a flange protruding from an outer peripheral surface of the motor housing 300 in an outer diameter direction may be formed at an upper end of the motor housing 300.

The stator 100 may have, for example, a shape in which a plurality of teeth are formed to protrude from an inner peripheral surface of a cylindrical core in an inner diameter direction and are disposed to be spaced apart from each other in a circumferential direction, an insulator made of an electrically insulating material surrounds the core and teeth, and coils are wound on an outer side of the teeth surrounded by the insulator. In addition, the stator 100 may have a shape in which a central portion thereof is vertically penetrated. In addition, the stator 100 may be formed in various shapes and configurations. In addition, the stator 100 may be provided in the motor housing 300, and an outer peripheral surface of the stator 100 may be coupled and fixed to an inner peripheral surface of the motor housing 300 in a state in which it is closely adhered to the inner peripheral surface of the motor housing 300.

The lower casing 200 may have a lower seating groove 211 formed downwardly concavely from an upper surface thereof so that a portion of the impeller 500 may be accommodated therein, and may have a lower flow path groove 212 concavely formed outside the lower seating groove 211 in a radial direction so that a fluid discharged from the impeller 500 may flow. In addition, the lower casing 200 may have a rotor accommodating part 220 formed to protrude downwardly from a central portion of the lower seating groove 211, and the rotor accommodating part 220 may be formed in the shape of a container downwardly concave from an upper side thereof. In addition, the rotor accommodating part 220 may have a lower bearing mounting part 222 formed at a lower end of a rotor accommodating space 221, which is a concave inner portion thereof, and a lower bearing 411 may be coupled to the lower bearing mounting part 222. Here, the lower bearing 411 may include a bushing B that may support a lower end of a rotation shaft 410 of the rotor 400 in the radial direction and a support pin P that may support the lower end of the rotation shaft 410 in an axial direction. Thus, the rotor 400 may be inserted into and disposed in the rotor accommodating space 221, which is the inner portion of the rotor accommodating part 220, and an outer peripheral surface of the rotor 400 may be disposed to be spaced apart from an inner peripheral surface of the rotor accommodating part 220. In addition, the rotor accommodating part 220 may be formed integrally with the lower casing 200 by injection-molding. In addition, the rotor accommodating part 220 of the lower casing 200 is inserted into a hollowed inside of the stator 100 and penetrate the stator 100, such that a lower end of the rotor accommodating part 220 may protrude downwardly beyond a lower end of the stator 100, and the lower end of the rotor accommodating part 220 may be in a state in which it is spaced apart from a bottom surface of the motor housing 300. In addition, an outer peripheral surface of the rotor accommodating part 220 may be coupled to an inner peripheral surface of the stator 100 in a state in which it is in contact with and closely adhered to the inner peripheral surface of the stator 100.

The upper casing 600 is coupled to an upper side of the lower casing 200, and an impeller accommodating space 601 in which the impeller 500 may be accommodated is formed in an inner portion between the upper casing 600 and the lower casing 200 by the coupling between the upper casing 600 and the lower casing 200. In addition, an upper seating groove 630 is formed upwardly concavely in a lower surface of the upper casing 600 so that a portion of the impeller 500 may be accommodated, and the lower seating groove 211 and the upper seating groove 630 form the impeller accommodating space 601. In addition, an upper flow path groove 632 may be concavely formed at a position corresponding to the lower flow path groove 212 of the lower casing 200 in the lower surface of the upper casing 600 so that the fluid discharged from the impeller 500 may flow. In addition, the upper casing 600 may include an inlet part 610 through which the fluid is introduced and an outlet part 620 through which the fluid is discharged, the inlet part 610 may have an introduction flow path 611 formed therein, and the outlet part 620 may have a discharge flow path 621 formed therein. In addition, the upper casing 600 has a central portion formed to be vertically penetrated, such that the upper seating groove 630 and the introduction flow path 611 of the inlet part 610 may be in communication with each other, and the upper flow path groove 632 and the lower flow path groove 212 may be in communication with the discharge flow path 621 of the outlet part 620. Here, the upper casing 600 may have an upper bearing mounting part 602 formed to extend from a lower end of the inlet part 610 toward the impeller accommodating space 601, and the upper bearing mounting part 602 may be disposed below a lower end of the inlet part 610. That is, the upper bearing mounting part 602 may be disposed in the impeller accommodating space 601 positioned below the introduction flow path 611. In addition, the upper casing 600 may further include a plurality of supports 612, which may be disposed to be spaced apart from each other in the circumferential direction. The plurality of supports 612 may have upper ends connected to an inner wall of the lower end of the inlet part 610 and lower ends connected to the upper bearing mounting part 602, and may be formed to extend in a shape in which they are inclined in the inner diameter direction from the upper ends to the lower ends. In addition, the upper bearing mounting part 602 may have an inclined surface 603 formed so that an upper side thereof is inclined in the inner diameter direction toward an upward direction, and the lower ends of the plurality of supports 612 may be connected to the inclined surface 603 of the upper bearing mounting part 602. That is, the upper bearing mounting part 602 may be formed in a shape in which an outer diameter thereof gradually decreases from an approximately intermediate point in a vertical direction toward the upward direction. In addition, an upper bearing 412 may be coupled to the upper bearing mounting part 602, and may include a bushing B that may support an upper end of the rotation shaft 410 of the rotor 400 in the radial direction and a support pin P that may support the upper end of the rotation shaft 410 in the axial direction. In addition, the upper bearing mounting part 602 and the supports 612 may be formed integrally with the upper casing 600 by injection-molding.

The impeller 500 serves to pressure-feed the fluid introduced through the inlet part 610 of the upper casing 600 toward the outlet part 620 by rotation. The impeller 500 may include an upper plate 510, a lower plate 520, and blades 530, and may be formed in a shape in which a plurality of blades 530 are disposed to be spaced apart from each other in the circumferential direction between the upper plate 510 and the lower plate 520 vertically spaced apart from each other. In addition, a through hole penetrating through both surfaces of the upper plate 510 is formed in a central portion of the upper plate 510, and an inner portion of the impeller 500 is in communication with the introduction flow path 611, which is an inner portion of the inlet part 610, through the through hole. In addition, an outer peripheral edge of the impeller 500 is disposed adjacent to the lower flow path groove 212 and the upper flow path groove 632, such that the fluid discharged from the impeller 500 may flow along the discharge flow path 621 formed by the flow path grooves and be then discharged through the outlet part 620 of the upper casing 600. In addition, as an example, the impeller 500 may be formed in a shape in which the blades 530 and the lower plate 520 are formed integrally with a core part of the rotor 400 and the upper plate 510 is coupled to upper sides of the blades 530. In addition, the impeller may be formed in various shapes. Thus, the fluid introduced into the inlet part 610 of the upper casing 600 may be introduced into the impeller 500 through the introduction flow path 611 and the through hole of the upper plate 510 of the impeller 500, may have a pressure raised by a centrifugal force according to the rotation of the impeller 500, may flow to the discharge flow path 621, may flow along the discharge flow path 621, and may be then discharged to the outside through the outlet part 620.

The rotor 400 may be provided in the rotor accommodating space 221 of the lower casing 200, and the outer peripheral surface of the rotor 400 may be disposed to be spaced apart from the inner peripheral surface of the rotor accommodating part 220, such that the rotor 400 may be rotatably provided. In addition, the rotor 400 has a permanent magnet coupled to an outer portion of the core in the radial direction, and has the rotation shaft 410 coupled to a central axis of the core. In addition, a lower end of the rotation shaft 410 of the rotor 400 may be rotatably coupled to the lower bearing 411, and an upper end of the rotation shaft 410 of the rotor 400 may be rotatably coupled to the upper bearing 412.

Here, a portion or entirety of the upper bearing mounting part 602 may be disposed in an introduction side of the impeller 500. That is, as illustrated, the upper bearing mounting part 602 may be disposed in the introduction side of the impeller 500. As an example, an insertion groove 420 may be formed downwardly concavely in a central portion of the lower plate 520, which is a lower end of the introduction side of the impeller 500, and an upper end of the rotor 400, the upper bearing mounting part 602 may be inserted into the insertion groove 420, and the insertion groove 420 and the upper bearing mounting part 602 may be spaced apart from each other.

Thus, the fluid introduced along the introduction flow path 611 of the inlet part 610 at the time of an operation of a motor may pass between the supports 612, may flow into the introduction side of the impeller 500, may have a pressure raised by the impeller 500 that rotates, may be discharged from a discharge side to the discharge flow path 621, may flow along the discharge flow path 621, and may be then discharged to the outside through the outlet part 620. Accordingly, a pressure drop of the fluid introduced into the introduction side of the impeller may be relatively decreased and generation of turbulence may be prevented, such that performance of the water pump may be improved. In addition, a length of the rotation shaft of the rotor may be relatively decreased, and thus, a rotational balance of the rotor may be improved, such that vibrations and noise according to the rotation of the rotor may be decreased.

Figure 7:
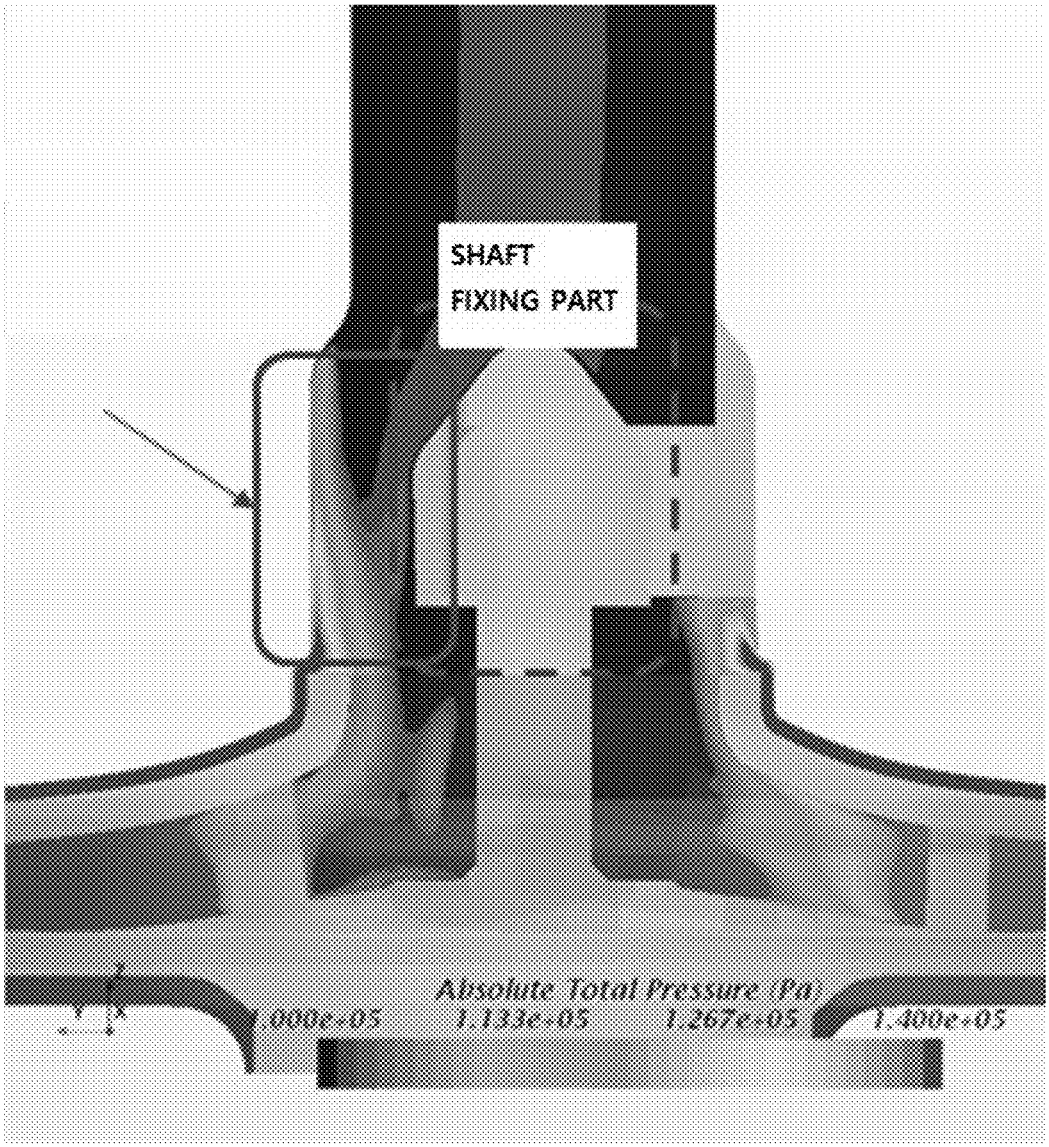
FIGS. 7 and 8 are images illustrating computational fluid dynamics (CFD) analysis results (fluid pressure) comparing the conventional water pump and the water pump according to an embodiment of the present invention with each other.
Figure 8:
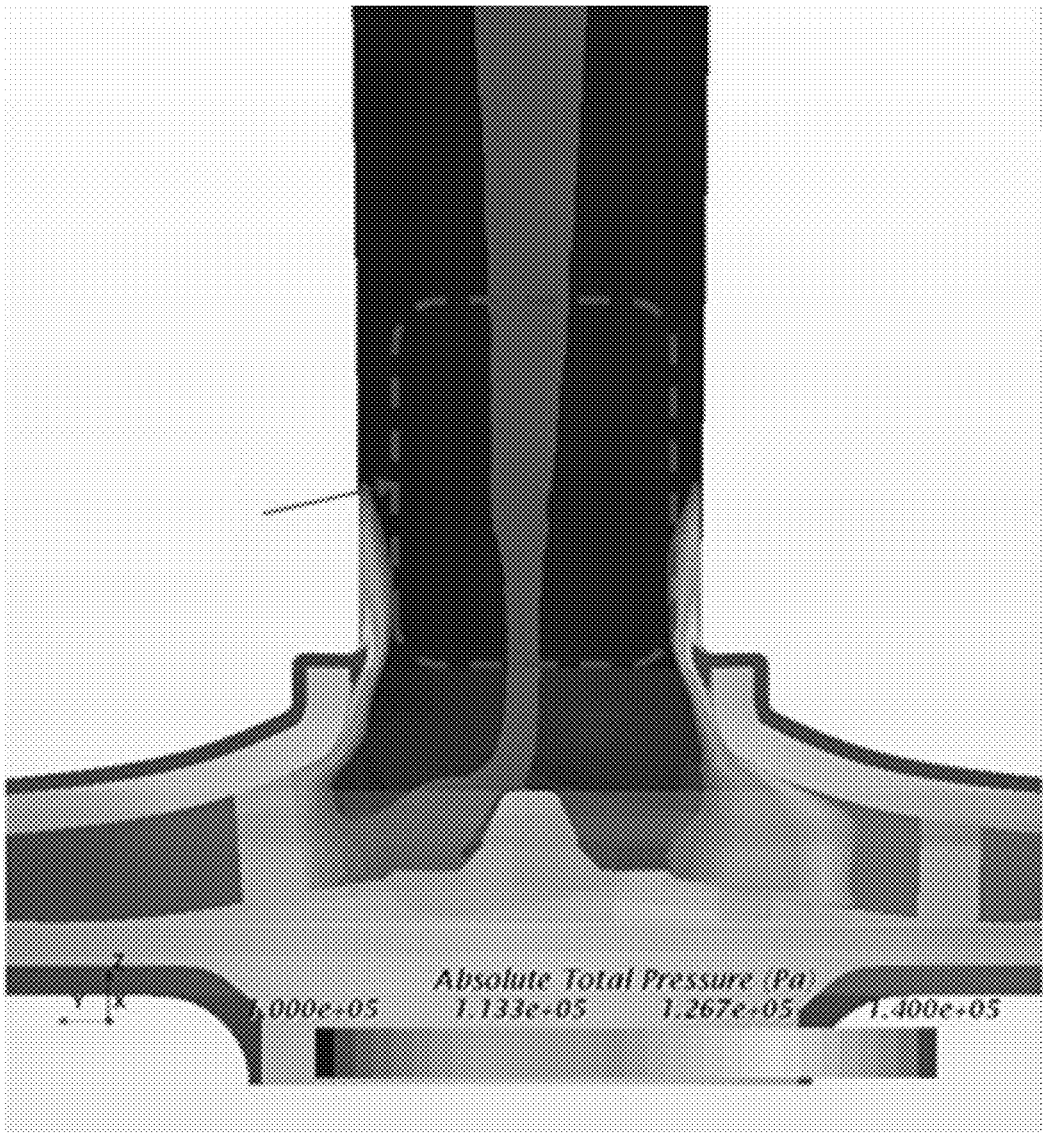

FIGS. 7 and 8 are images illustrating computational fluid dynamics (CFD) analysis results (fluid pressure) comparing the conventional water pump and the water pump according to an embodiment of the present invention with each other.

Referring to FIG. 7, it can be seen that in the conventional water pump, a pressure of the fluid is relatively increased in the vicinity of the upper bearing mounting part because a pipe conduit through which the fluid may flow is narrowed due to the upper bearing mounting part disposed in the introduction flow path, and it could be confirmed that a flow rate of the fluid introduced into the introduction side of the impeller is decreased accordingly. On the other hand, referring to FIG. 8, it can be seen that in the water pump according to an embodiment of the present invention, a pressure drop of the fluid flowing into the introduction side of the impeller hardly exists because there is no upper bearing mounting part in the introduction flow path.

In addition, a lower end of the inclined surface 603 of the upper bearing mounting part 602 may be disposed at a height corresponding to an upper surface of the lower plate 520, which is an inner bottom surface of the impeller 500 adjacent thereto. Thus, the fluid flowing along the inclined surface 603 of the upper bearing mounting part 602 may be more smoothly introduced into the impeller 500, such that the performance of the water pump may be further improved.

In this case, the upper surface of the lower plate 520, which is the inner bottom surface of the impeller 500, is formed in a shape in which it is inclined or bent upwardly from an outer side in the radial direction toward an inner side in the radial direction, such that pressure loss due to the flow of the fluid may be further decreased, and thus, the performance of the water pump may be further improved. In addition, as an example, as illustrated, both the upper plate 510 and the lower plate 520 of the impeller 500 may be formed in a shape in which they are inclined or bent upwardly from the outer side in the radial direction toward the inner side in the radial direction. In addition, the upper plate 510 and the lower plate 520 of the impeller 500 may be formed in various shapes.

According to the present invention, performance of the water pump may be improved by preventing the pressure drop of the fluid and the generation of the turbulence in the introduction flow path through which the fluid is introduced into the introduction side of the impeller.

In addition, according to the present invention, the length of the rotation shaft of the rotor may be relatively decreased, such that the vibrations and the noise according to the rotation of the rotor may be decreased.

The present invention is not limited to the embodiments described above, and may be applied to various fields. In addition, the present invention may be variously modified by those skilled in the art to which the present invention pertains without departing from the gist of the present invention claimed in the claims.

What is claimed is:

1. A water pump comprising:

a lower casing in which a rotor accommodating part having a rotor accommodating space formed downwardly concavely from an upper surface thereof is formed to protrude downwardly and a lower bearing mounting part is formed at a lower end of an inner portion of the rotor accommodating part;

an upper casing which is coupled to an upper side of the lower casing and has an impeller accommodating space formed therein by the coupling with the lower casing and in which an inlet part in communication with the impeller accommodating space to introduce a fluid and an outlet part discharging the fluid are formed and an upper bearing mounting part is formed to extend from a lower end of the inlet part toward the impeller accommodating space;

an impeller rotatably provided in the impeller accommodating space; and a rotor provided in the rotor accommodating space of the lower casing, coupled to the impeller, and having a rotation shaft of which both ends are rotatably coupled to the lower bearing mounting part and the upper bearing mounting part, wherein a support pin for supporting an upper end of the rotation shaft of the rotor in an axial direction is coupled to the upper bearing mounting part below an upper surface of the impeller, and wherein a lower surface of the support pin is formed as a flat surface, and the upper end of the rotation shaft is formed as a curved surface, extending convexly in an upper direction.

2. The water pump of claim 1, wherein the upper casing further includes a plurality of supports having upper ends connected to an inner wall of the lower end of the inlet part and lower ends connected to the upper bearing mounting part.

3. The water pump of claim 2, wherein the plurality of supports are disposed to be spaced apart along a circumferential direction, and the plurality of supports are formed to extend to be inclined in an inner diameter direction toward a downward direction.

4. The water pump of claim 3, wherein the upper bearing mounting part has an inclined surface formed so that an upper side thereof is inclined in the inner diameter direction toward an upward direction, and the lower ends of the plurality of supports are connected to the inclined surface of the upper bearing mounting part.

5. The water pump of claim 2, wherein a portion or entirety of the upper bearing mounting part is disposed in an introduction side of the impeller.

6. The water pump of claim 2, wherein an insertion groove is formed downwardly concavely formed in a lower end of an introduction side of the impeller and an upper end of the rotor, and the upper bearing mounting part is inserted into the insertion groove and is disposed to be spaced apart from the insertion groove.

7. The water pump of claim 4, wherein a lower end of the inclined surface of the upper bearing mounting part is disposed at a height corresponding to an inner bottom surface of the impeller adjacent thereto.

8. The water pump of claim 7, wherein the inner bottom surface of the impeller is formed in a shape in which it is inclined or bent upwardly from an outer side in a radial direction toward an inner side in the radial direction.

9. The water pump of claim 1, wherein a lower bearing is coupled to the lower bearing mounting part, an upper bearing is coupled to the upper bearing mounting part, and the both ends of the rotation shaft of the rotor are rotatably coupled to the lower bearing and the upper bearing.

10. The water pump of claim 1, further comprising:

a motor housing formed in the shape of a concave container of which an upper side is opened; and a stator provided in the motor housing.

* * * * *